United States Patent [19]

Leib

[11] Patent Number: 4,529,246

[45] Date of Patent: Jul. 16, 1985

[54] PATIENT CHAIR

[76] Inventor: Roger K. Leib, 1064 S. Crescent Heights Blvd., Los Angeles, Calif. 90035

[21] Appl. No.: 248,852

[22] Filed: Mar. 30, 1981

Related U.S. Application Data

[63] Continuation-in-part of Ser. No. 110,340, Jan. 7, 1980, abandoned.

[51] Int. Cl.[3] ..... A47C 3/00

[52] U.S. Cl. ..... 297/285; 297/286; 297/287; 297/294; 297/446

[58] Field of Search ..... 297/294, 295, 287, 288, 297/419, 447, 441, 411, 410, 464, 239, 310, 285, 282, 276, 280, DIG. 10

[56] References Cited

U.S. PATENT DOCUMENTS

| | | | |
|---|---|---|---|
| D. 252,901 | 9/1979 | Peterson | D6/72 |
| D. 262,502 | 1/1982 | Wilson | D6/56 |
| 693,323 | 2/1902 | Gritton | 297/452 |
| 1,791,453 | 2/1931 | Mies | 297/287 |
| 1,928,939 | 10/1933 | Larsen | 297/295 |
| 1,950,226 | 3/1934 | Cable | 297/287 |
| 1,979,073 | 10/1934 | Larjen | 297/294 |
| 2,064,137 | 12/1936 | Zerbee | 297/300 |
| 2,069,456 | 2/1937 | McGowen | 297/287 |
| 2,071,084 | 2/1937 | Nolon | 297/295 |
| 2,121,130 | 6/1938 | McGowen | 297/287 |
| 2,135,657 | 11/1938 | Church | 297/445 |
| 2,186,705 | 1/1940 | Lorenz | 297/295 |
| 2,544,850 | 3/1951 | Martonicz | 297/310 X |
| 2,586,262 | 2/1952 | Robins | 297/294 X |
| 2,625,205 | 1/1953 | Holmes | 297/295 |
| 2,679,893 | 1/1954 | Bennett | 297/282 |
| 2,699,200 | 1/1955 | Lingle | 297/294 |
| 2,905,230 | 9/1959 | Gabriel | 297/410 |
| 3,092,417 | 6/1963 | Drabert | 297/291 |
| 3,101,217 | 8/1963 | Requa | 297/391 X |
| 3,147,997 | 9/1964 | Major | 297/452 |
| 3,379,450 | 4/1968 | Jones et al. | 297/DIG. 10 |
| 3,379,474 | 4/1968 | Schwarz, Jr. | 297/441 |
| 3,762,769 | 10/1973 | Poschl | 297/284 |
| 3,815,955 | 6/1974 | Gibilterra | 297/295 |
| 3,876,250 | 4/1975 | Eberle | 297/446 |
| 4,049,315 | 9/1977 | Jacobson | 297/447 |
| 4,067,606 | 1/1978 | Fouchereau et al. | 297/239 X |
| 4,234,228 | 11/1980 | Flamm | 297/464 |

FOREIGN PATENT DOCUMENTS

| | | | |
|---|---|---|---|
| 560673 | 9/1932 | Fed. Rep. of Germany | 297/294 |
| 764919 | 3/1934 | France | 297/288 |
| 907057 | 6/1945 | France | 297/294 |
| 529845 | 8/1955 | Italy | 297/295 |
| 74283 | 5/1932 | Sweden | 297/295 |

*Primary Examiner*—James T. McCall
*Attorney, Agent, or Firm*—Jeffrey G. Sheldon

[57] ABSTRACT

A chair is provided which finds primary, although not exclusive, use as a patient's chair in a hospital room. The chair is formed of both rigid and flexible resilient members, composed respectively, for example, of tubular and flat barstock spring steel, which is configured to form a frame for the chair, and which provides a base, front legs, and support for the seat, back and arm rests of the chair; and a web-like member attached to the frame to constitute the seat and back of the chair. The seat and back are supported on the frame for resilient reciprocal movement. A pair of arm rests are attached to the frame, on either side of the seat. The web-like member, for example, may be formed of polyester mesh. An upholstered cover may be provided which may be attached to the web-like member by strips of Velcro and plastic rivets. The upholstered cover may be formed of vinyl, or other appropriate material, although the patient may sit directly on the web-like material. An upholstered head rest may be attached to the top of the back by Velcro and permanently-sewn limiting straps which provide height adjustability, and which permit it to hang behind the chair when not in use.

26 Claims, 13 Drawing Figures

PATIENT CHAIR

This application is a continuation-in-part of copending application Ser. No. 110,340 filed Jan. 7, 1980, now abandoned.

BACKGROUND

This invention relates to a chair which because of its characteristics and construction, as will be described, facilitates use by weakened, partially disabled, or infirm users suffering a variety of ailments in a manner constituting a distinct improvement over patient-type chairs of the prior art. Because of the comforts it provides, the chair of the invention also is appropriate for the seating needs of healthy users, and it is also a distinct improvement over chairs of the prior art for general seating use.

There are many chair configurations which have found use in the hospital room, nursing home, extended care facility, or sick room at home. However, the institutional and physiologic implications of such a use have only been addressed in a limited way insofar as the prior art patient's chair is concerned.

The foremost implication is the widespread problem of weakened users being unable to get out of the usual easy, or lounge, chairs by themselves because they haven't the strength to do so in the particular groups of muscles called into play by the configuration of the chair they were trying to get out of (typically the arm and upper body muscles). The problem is compounded by the relatively widespread incidence of back problems common among nurses and aides because of their having throughout their shift to help patients or wards out of chairs and into standing positions. One object of the invention is to provide a chair which enables the user to utilize his strongest muscles (usually leg muscles) for rising up out of the chair.

Another major problem with the prior art chairs is that the institutional need for washability has previously resulted in chairs, all body contact portions of which have been made of non-porous upholstery and other non-porous materials. The free-flow of perspiration through the skin pores and evaporating is thus prevented by the impervious barrier, and a evaporating is thus prevented by the impervious barrier, and a significant amount of perspiration collects in contact areas on the skin or clothing with resulting discomfort. Discomfort of the patient is further compounded by the accompanying build-up of body heat, which collects in the same manner. When many such non-porous upholstery-covered chairs are subjected to institutional cleaning, moisture frequently collects in closed crevices or finds its way into the stuffing materials, causing mildew, rot and corrosion. A highly unsanitary condition results with such liquids or body fluids. Another object of the invention is to provide a chair which supports the user on a porous yet fully washable stratum which requires no additional stuffing, cushioning, or support materials, thus making the chair breathable, washable and fully drying.

Another problem with prior art chairs used in health care settings is the lack of seated comfort they provide. A major factor in discomfort is the contour along which the spinal column is supported, particularly with reference to support in the lumbar area and neck region. Chairs commonly lack correctly positioned and adequately convex lumbar-area supports. Furthermore, when head support is provided, the height of such support is often fixed so that all but appropriately dimensioned users suffer discomfort. An object of the present invention is to provide a chair which provides superior back comfort and head support adjustable within all but the extreme ranges of user sizes.

Another more subtle aspect of seating discomfort is caused by the inevitable concentration of body weight on specific portions of flesh, which in prolonged conditions can result in decubitis, or bed sores. Under normal conditions of health and mobility, such pressure results in the desire to shift body weight and redistribute the pressure. However, in a weakened state and in a static chair, patients may be unable to do so.

An object of the present invention is to provide a chair in which slight rocking motion can be achieved which provides an opportunity for exercise to the debilitated user; and which also allows the constant partial shifting and redistribution of body weight and helps the patient to dissipate institutionally and health-related anxieties by moving and rocking. Should decubitis already have set in, it is an object of the present invention to provide adequate air circulation to affected portions in order that they might heal.

A further problem with chairs of the prior art that accommodate a rocking motion by the user, is that the axis of rotation usually falls somewhere between the user's knees and pelvis, so that as the user rocks backward, there is a tendency for the knees to move upwardly, causing the feet to leave the floor and creating an excess of pressure on the underside of the thighs. In addition, there is a further tendency in the prior art chairs, as the user pushes downward on the fronts of armrests in order to lift himself upwardly, for the armrest fronts to rotate downwardly, opposite the direction in which the user is trying to push. Another object of the present invention is to provide a chair with a rocking motion, the axis of which is located in front of the knees so that the knees and armrest fronts remain stable while the body rotates backward into the chair back; and one that has no tendency to rock forwardly when the user pushes down on the armrests to lift himself out of the chair.

Yet another problem with many prior art chairs used in health care settings in the manner in which impact is absorbed when a user drops into the seat. The most common means of absorbing impact shock is with heavy padding, which besides its potentially hygienic limitations, if effective, often permits the sitter to sink too low to be able to lift himself out of the chair easily, and creates both bulk and weight which limit an institutional staff's ability to move the chair and adequately perform necessary floor maintenance operation.

Such stuffing materials also often create fire hazards by the use of highly combustible materials with high smoke density and toxicity. A further object of the present invention is to provide a chair of minimum bulk with minimal use of materials that would fuel a fire and the structure of which absorbs initial impact by the user.

Another problem addressed by the present invention is that of stability in use, since many health care chairs have a tendency to tip forwards, sideways, or backwards under the varied conditions in which users try to enter and exit them. An object of the present invention is to provide a chair which will be stable under all normal circumstances of use.

A final problem encountered in the health care field are a variety of functions or treatments not normally performed in a lounge chair which must be performed or endured by a patient occasionally or intermittently while seated in the same chair. One such function is eating, anoother is urinating, another is the draining of body fluids into drainage bags, and still another is sitting upright or remaining seated under conditions of semi-consciousness or disorientation. A final object of the present invention is to provide a chair which accepts a variety of optionally used fittings to accommodate this diverse range of needs.

The objects of the present invention are accomplished by providing a chair which is primarily intended for use by the weakened, parially disabled, or infirm user such as are typically found in hospitals, nursing homes, extended care facilities, and sickrooms, and which is directed primarily at the geriatric, orthopaedic, rehabilitating, psychiatric, and maternity patient. It is particularly suited to these applications in that it is easy to enter and exit, is fully washable yet ventilating and comfortable to the skin, fully drying, with no areas to entrap liquids, provides excellent back support particularly in the lumbar area and adjustable-height head support at the small of the neck, provides with no moving parts a soothing slight rocking motion that increases rearwardly in order to shift and redistribute body weight without lifting feet off the floor while maintaining stable arm fronts against which to push in exiting, minimizes skeletal shock upon sitting impact without padding of any kind which maight potentially fuel a fire, is unbulky and easily moved for cleaning, remains stable in all normal use, and accommodates a diverse range of optional fittings.

The chair as described above consists of a tubular or barstock steel base frame vertical leg components of which support tubular or bar stock steel side frames which in turn support a web-like member. The web-like member, as also mentioned above, may be formed of a polyester mesh or other suitable washable material, and the chair is contructed so that the web-like member may be removed for replacement purposes.

A major advantage of the chair is the placement and support of armrests. They are axially supported at their front end by a relatively rigid member so all downward force exerted at their front ends is resisted by the vertical legs of the chair acting as axial struts, thus providing the user a stable stratum against which to push for exiting the chair. Furthermore, these armrests extend well past the seat front, enabling the user to first pull himself far forward enough so that he is then pushing downwardly over the center of gravity of his feet enabling his leg muscles to perform a substantially higher proportion of the work than his arm and upper body msucles would otherwise have had to perform.

Another advantage is that portions of the seat and back that actually support the user's weight are a structurally efficient tensile sling, allowing use if a minimal amount of material in one thin layer. As shown in one embodiment, this sling consists of an open polyester mesh which provides both full ventilation to the user and complete washability. The amount of material required is so minimal, in fact, that it dries quickly without trapping water and contributes so little potential fuel that it is not subject to present flammability laws governing upholstered furniture.

Another advantage of the chair is the seated comfort it provides. The front-cantilevered side frames deflect rearwardly, leaning the user back into the chair with a slight but soothing rocking motion which further shifts concentration of the user's body weight to different tissue areas as his center of gravity shifts correspondingly back and forth. Since the point of fixing of the flexing cantilevered side frames is at their front end, the corresponding axis of rotation of side frames is just above and in front of the knees, which therefore remains relatively stable so there is no lifting off the floor of the user's feet. Furthermore, the properly-placed lumbar support gives adequate support to the critical lumbar region, while the headrest can be adjusted up or down to correspond with the small of the neck within the range limited by its permanently sewn attachment straps via hook and loop tape fasteners. And as the user drops into the chair, the flexure of the side frames absorbs impact and prevents skeletal shock, for which heavy padding might otherwise be needed.

The elimination of the need for heavy padding thus produces a less bulky chair which can be moved more easily for cleaning, relocation, or even patient transport.

Yet another advantage of the chair is that the portions of the base that are on the floor are sized large enough so that the user's center of gravity always falls within those boundaries delineated by the base, thus precluding any instability in normal use.

Finally, the skeletal nature of the chair's structure permits the attachment of a multitude of accessories to accommodate the treatments or functions not normally performed in a lounge chair.

DETAILED DESCRIPTION OF THE ILLUSTRATED EMBODIMENTS

Figure 2:
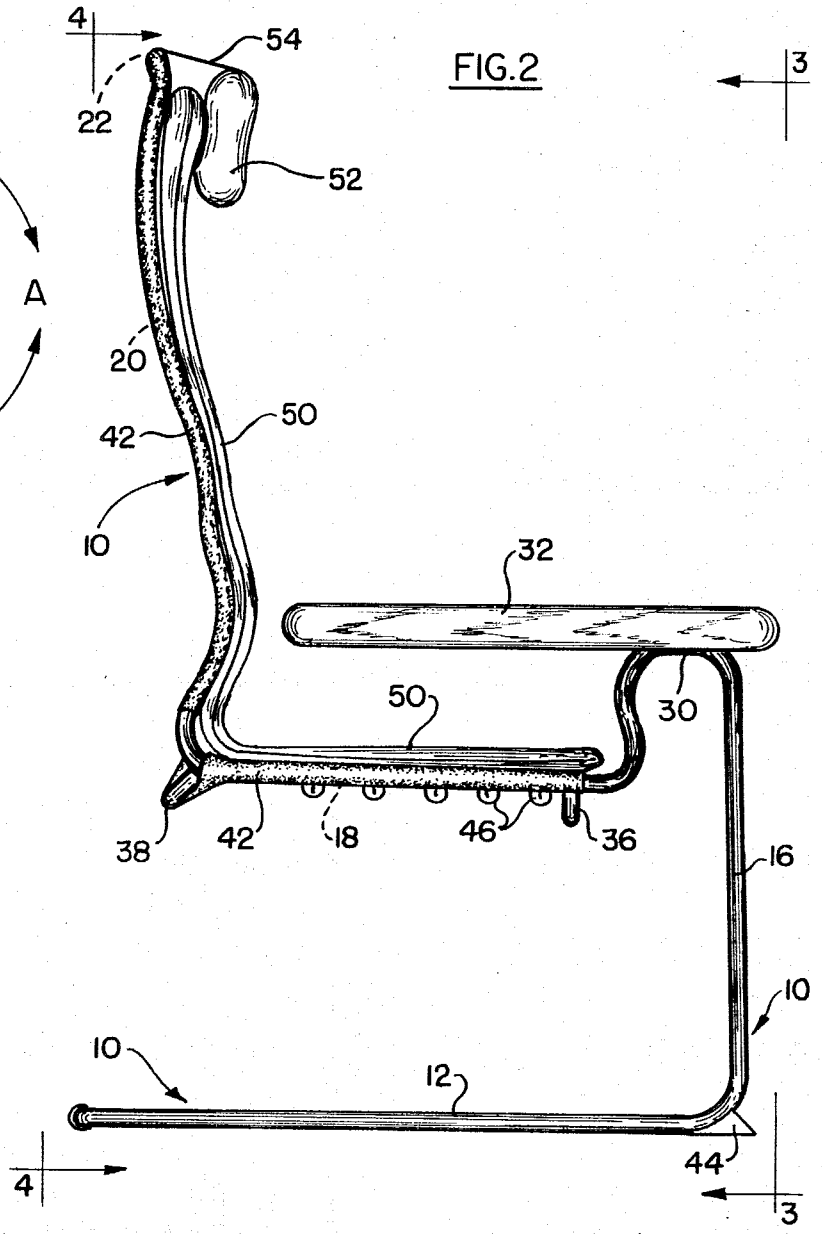
FIG. 2 is a side elevation of the chair of FIG. 1 with an upholstered pad placed on the chair.

The chair of the present invention, in the embodiment shown in FIGS. 1-6 includes a frame formed of a resilient member 10 which may be composed, for example, of tubular steel. The resilient member is shaped to provide a base for the chair having two spaced and parallel side sections 12 and a transverse section 14. The tubular member 10 also forms two spaced and parallel legs 16 at the forward end of the chair, and two spaced and parallel side members 18 which constitute a seat-supporting section of the chair, as well as two spaced and converging side members 20 which constitute a back supporting section of the chair. The tubular members 12 and 16 form an open front so that an ottoman may be slid under and stored below the chair. The side members 18 are configured so that there is a slight inclination of the seat away from the front of the chair when the weight is removed, to assist the patient in getting out of the chair.

Figure 1A:
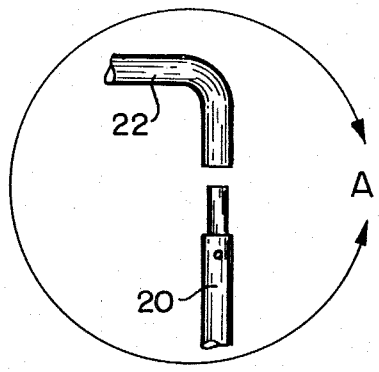
FIG. 1A is a fragmentary representation of a detail A of the chair of FIG. 1.

As shown in FIG. 1A, a tubular transverse member 22 is removably received in the ends of the side members 20.

A web-like member 24 is supported on the frame to constitute the seat and back of the chair. The web-like member is sewn or otherwise attached to a marginal fabric 42. The web-like member and marginal fabric form a sheath for receiving the converging side members 20 of the back supporting section of the chair. The web-like member 24 may be formed, for example, of polyester mesh. The tubular transverse member 22 is removable, to permit the web-like member 24 and marginal fabric 42 to be removed from the frame for washing or replacement purposes. The member 22 is bent back into a concave shape, as best shown in FIG. 2, to prevent the patient from hitting his head.

As shown, the tubular member 10 is configured to provide a pair of approximately U-shaped, or C-shaped, sections 30 at the respective junctions between the forward ends of side members 18 and legs 16. The sections 30 by the nature of their geometry increase the flex and period of flex of the seat of the chair under load, and distribute stresses along their length. A pair of arm rests 32 are affixed at their forward ends to the U-shaped sections 30, the arm rests being formed of an appropriate rigid material such as wood or plastic. The arm rests extend a substantial distance beyond the front edge of the seat to permit the patient to grasp the ends of the arm rests to push himself out of the seat.

U-shaped transverse members 36 and 38 are attached to the forward and rear ends, respectively, of the side members 18 for reinforcing purposes.

Figure 1:
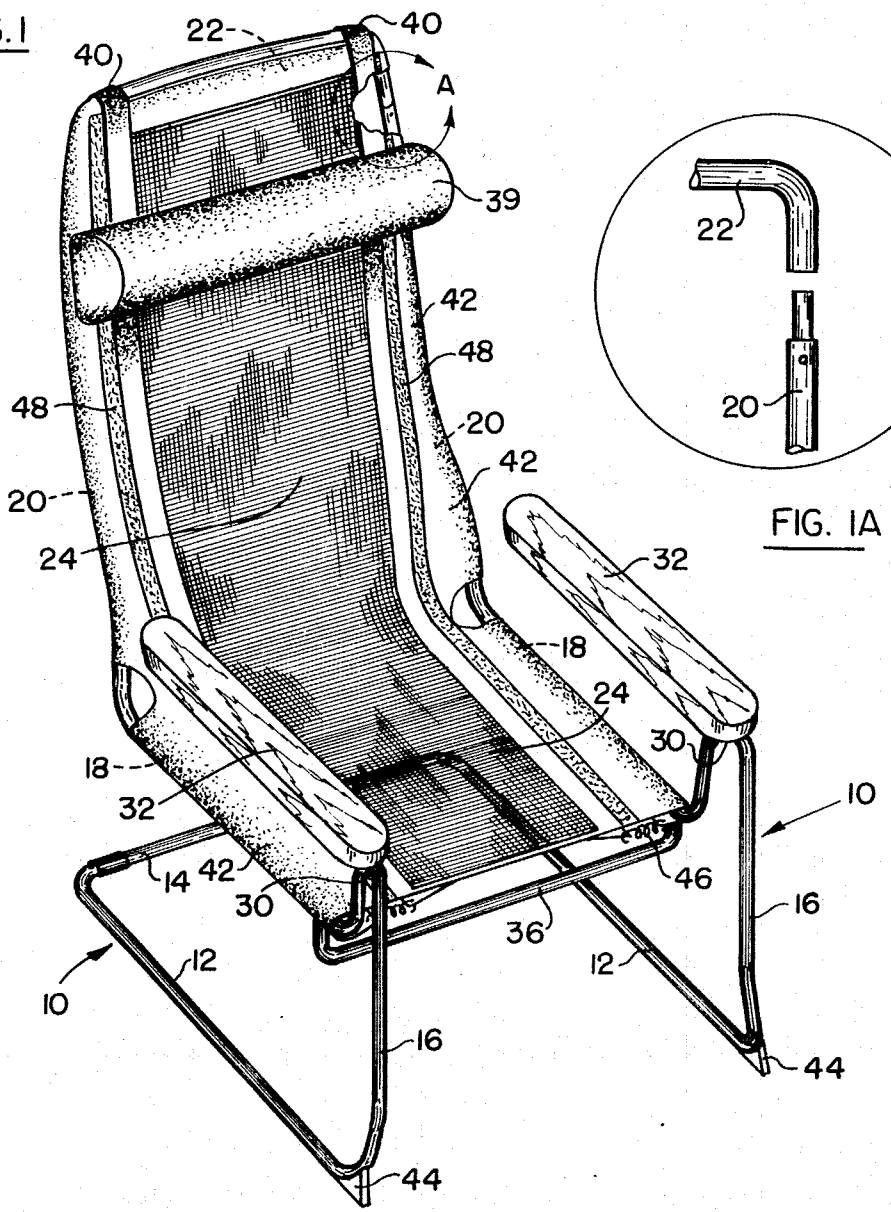
FIG. 1 is a perspective view of a patient's chair constructed in accordance with one embodiment of the invention.
Figure 4:
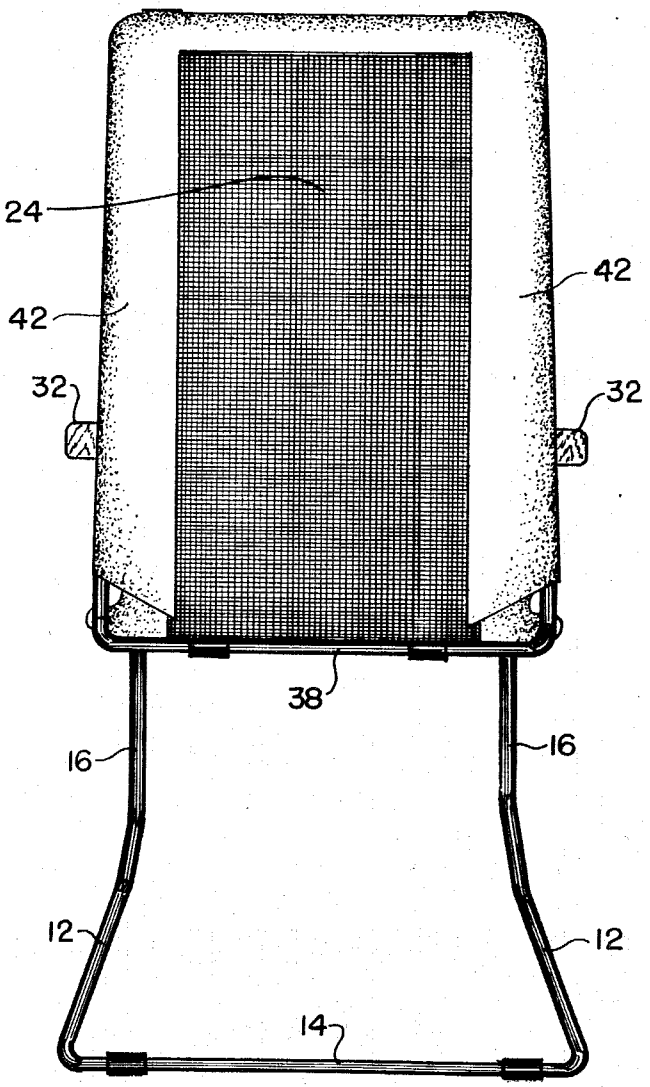
FIG. 4 is a back elevation of the chair.

As shown in FIG. 1, two strips 48 of Velcro material are fastened to the marginal fabric 42 and extend down the front surface of the back and along the top surface seat of the chair. A head rest 39, which may be in the form of an upholstered cushion, is hung on the back of the chair by straps 40, or other appropriate fastenings.

The upright front members 16 preferably diverge towards the base so that when the arm rests are removed the chairs may be nested and stacked for more compact shipping and storage.

Figure 5:
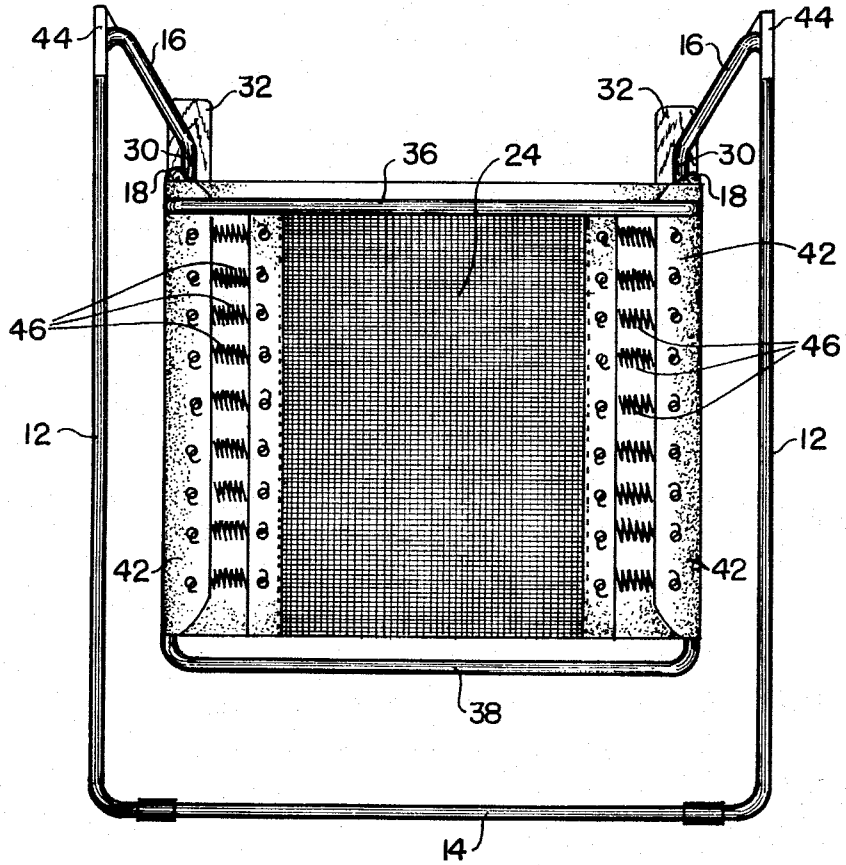
FIG. 5 is a bottom view of the chair.

As shown best in FIG. 5, the portion of the web-like member 24 forming the seat of the chair is supported on the frame by a series of springs 46 which extend between a marginal fabric sewn to the side edges of the web-like member under the seat, and the marginal fabric 42 which is folded around and under the side members 18.

A pair of members 44, formed of plastic or other appropriate material are attached to the tubular member 10 at the respective junctions between the side sections 12 and front legs 16 to prevent the chair from having any tendency to tip over in a forward direction.

Figure 3:
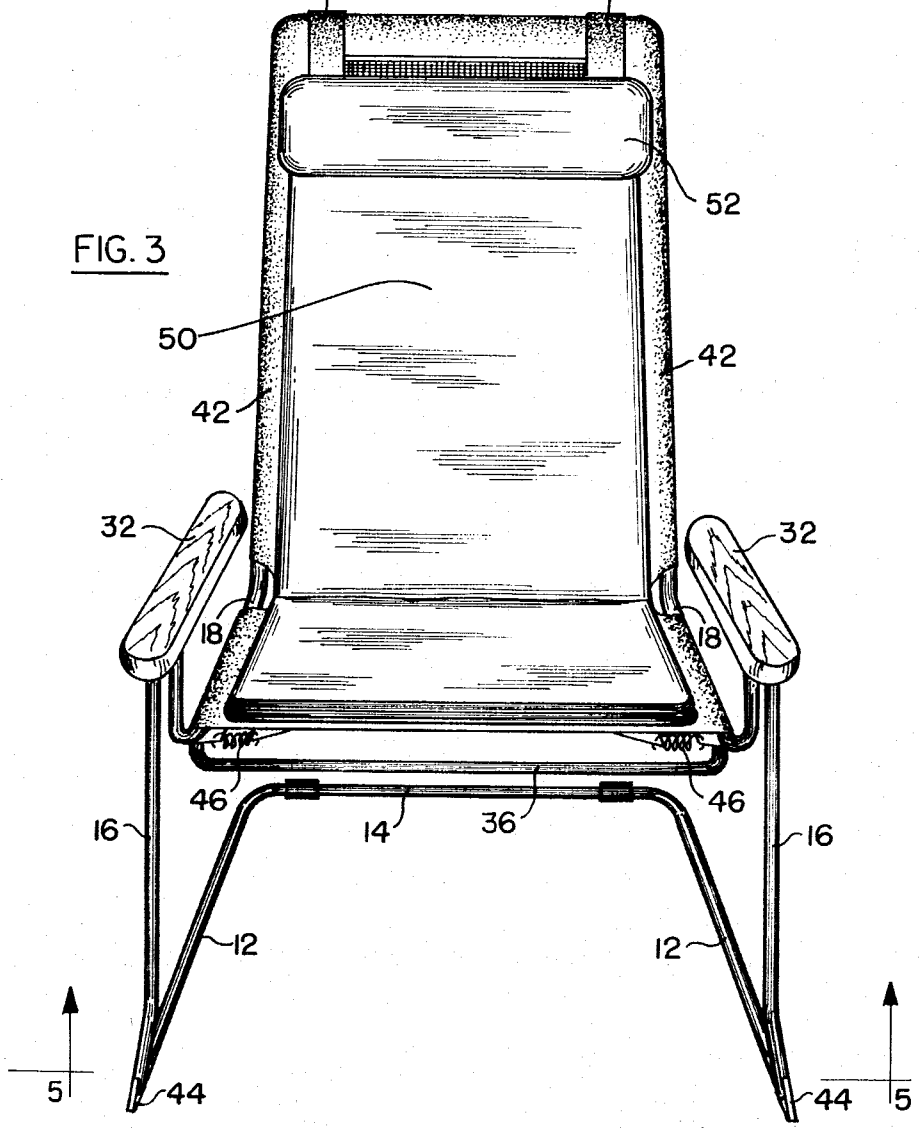
FIG. 3 is a front elevation of the chair with the upholstered pad in place.

A pad 50 (FIG. 6), in the form of an upholstered cushion covered with vinyl, or other appropriate material, may be provided which can be used with the chair, as shown in FIGS. 2 and 3, although the use of such a pad is not essential. The pad is equipped with Velcro fasteners which engage the Velcro strips 48 to hold the pad on the chair. Pad 50 is equipped with a head rest 52 which is attached to the pad by straps 54.

Figure 8:
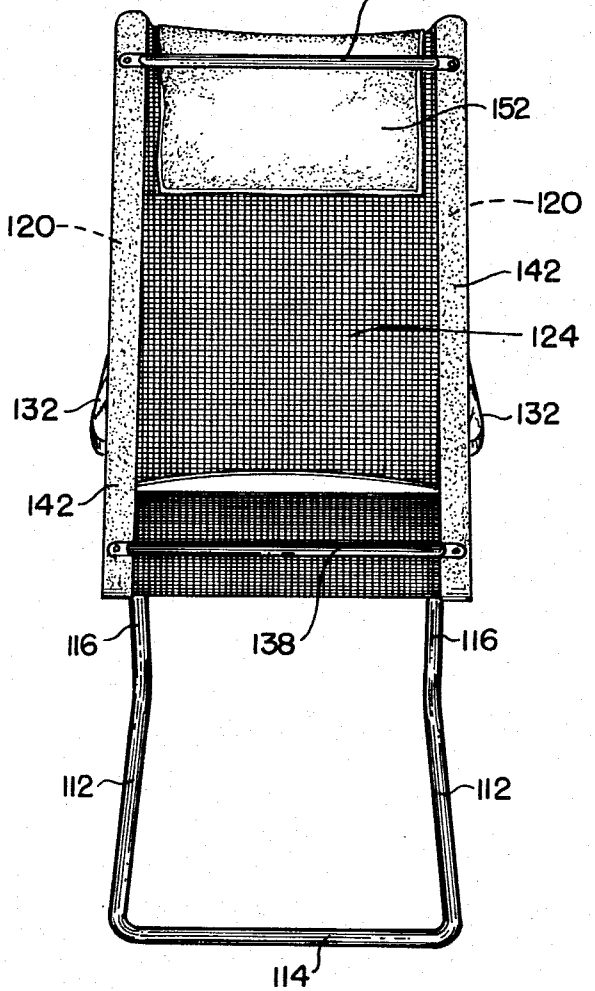
FIG. 8 is a front view of the second embodiment.
Figure 7:
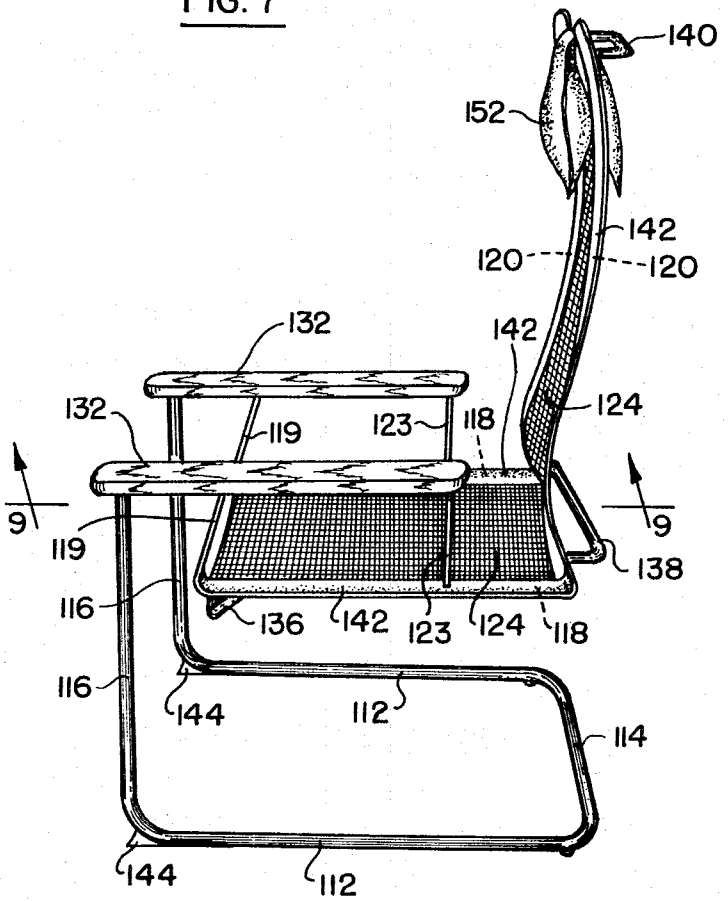
FIG. 7 is a side on perspective view of a second embodiment of the invention.
Figure 9:
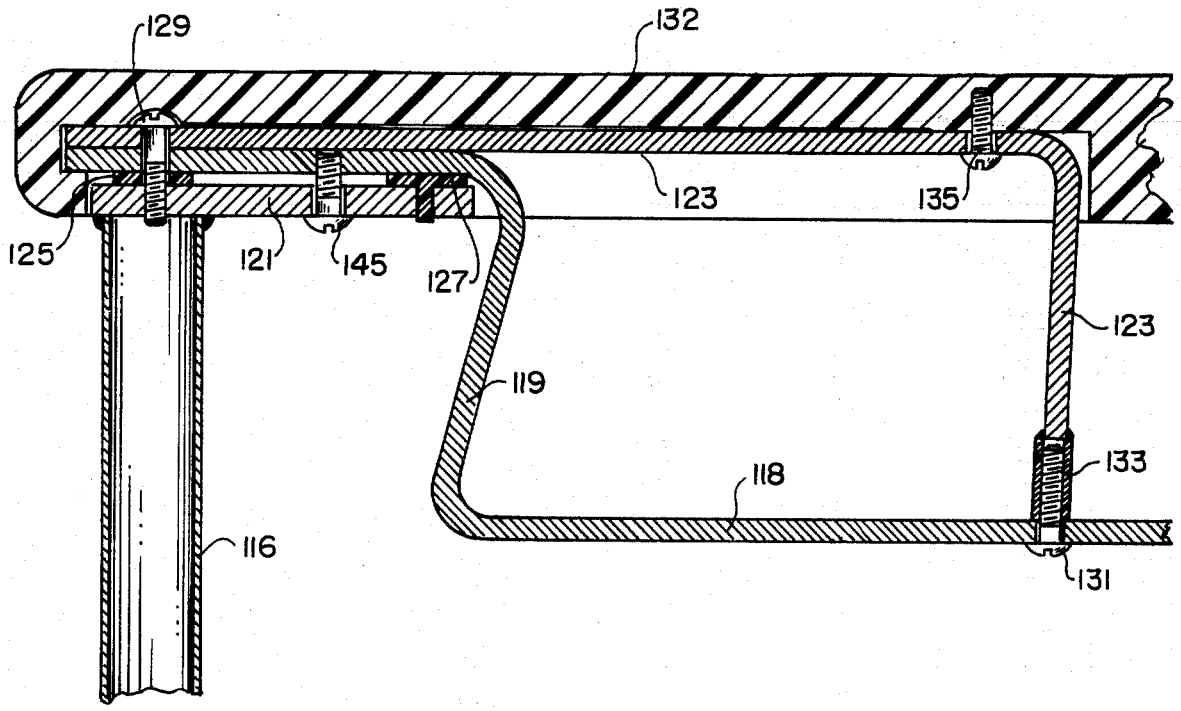
FIG. 9 is an enlarged sectional view of the arm assembly of the chair of the second embodiment, taken along the line 9—9 of FIG. 7.

In the embodiment of FIGS. 7, 8 and 9, the chair includes a base formed, for example, of tubular steel. The base has two spaced and parallel side sections 112, a transverse section 114, and two spaced and parallel upright legs 116 at the forward end thereof. As shown in FIG. 9, the upper end of each of the legs 116 is welded to an elongated flat plate 121 which may be formed of flat high-strength steel bar stock. The steel plates provide mounting for two spaced and parallel side members 118 which constitute the seat supporting section of the chair, and two spaced and converging side members 120 which constitute the back supporting section of the chair. The steel members 118, 120 are held spaced apart in position by three transverse bars 136, 138 and 140.

The two seat-supporting side members 118 also each has a forward Z-shaped section 119 which, as shown in FIGS. 7 and 9 extends upwardly from the corresponding side member 118 and under a corresponding arm rest 132. The side members 118 and 120, and section 119, and strip 123 on each side of the chair constitute a cantilevered leaf-spring assembly capable of being deflected with respect to leg 116 through a substantial range without permanent distortion or set. These members likewise may be formed of flat steel barstock, heat treated to have spring action mechanical properties. As shown in FIG. 9, the forward end of each section 119 extends between a steel plate 121 welded to the upper end of leg 116, and an L-shaped steel strip 123. The purpose of the L-shaped steel strip 123 is to pull down the rear end of the arm rest 132 when the seat is deflected downwardly and to give added strength to the seat-supporting member 118 so that the combination of members will have additional load-bearing capacity. Soft rubber spacers 125 and 127 are provided between the plate 121 and section 119 in order to enhance the apparent resiliency of member 118 and to prevent the sharp upper rear corner of member 121 from creating a point of concentrated stress on member 118 at their point of contact.

Section 119 is secured to plate 121 by a bolt 129, and the rear end of strip 123 is secured to member 118 by a bolt 131 which is received in a threaded sleeve 133 welded into the end of strip 123. Arm rest 132 is held in place at its rear end by a nut and bolt 135, the head of which is embedded in the armrest, and at its front end by overlapping the section 119 and strip 123. A bolt 145 limits the motion of section 119 relative to plate 121 in order to preclude pulling the head off bolt 129, and to keep member 118 and plate 121 in parallel alignment.

By pulling forward and then up on the armrest 132, the front of the armrest may be pulled over and disengaged from section 119 and strip 123, giving access to the head of bolt 129. Tightening or loosening the bolt 129 against the soft rubber spacers 125, 127 adjusts the angle of inclination of member 118 (the inclination of the seat) to accommodate more exactly to various patient weights by increasing the height or the rear of the seat for heavier patients.

The assembly described above provides a strong support for the seat of the chair and yet provides for a resilient rocking action by the occupant. As in the previous embodiment, the members 112 and 116 form an open front so that an ottoman may be slid and stored under the chair.

A web-like member 124 wraps around and is supported on the side members 118 and 120 to constitute the seat and back of the chair. A marginal fabric 142 receives the side members and serves as a decorative trim. The marginal fabric is sewn over the web-like member. The web-like member 124, as in the previous embodiment, may be formed of polyester mesh, and it is removable for washing purposes.

A head cushion 152 is adjustably attached to the web-like member 124 by appropriately sewn and located limiting straps and hook and loop fastener tape. A pair of members 144, formed of plastic or other appropriate material are attached to the forward end of the base, as shown, to prevent forward tipping of the chair and to prevent the chair from sliding when the patient is getting up out of the chair.

Figure 6:
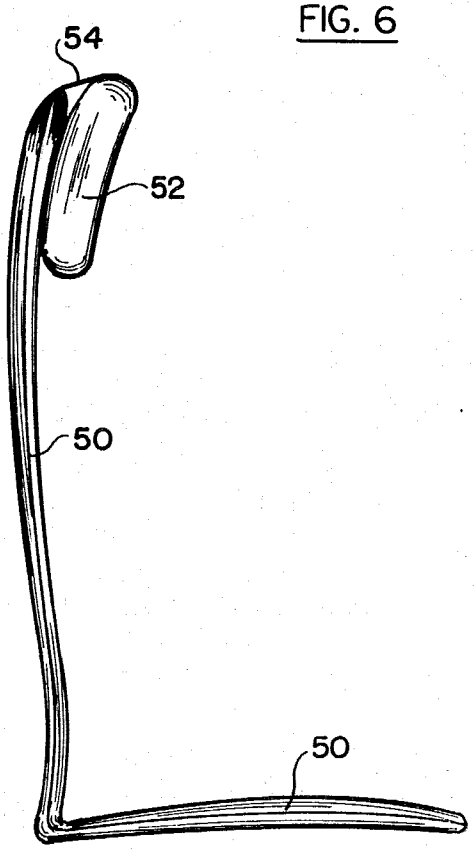
FIG. 6 is a side view of the upholstered pad which may be placed on the chair, if so desired.

A pad, similar to the pad 50 of FIG. 6 may be provided for use with the chair of FIGS. 7, 8 and 9.

Figure 12:
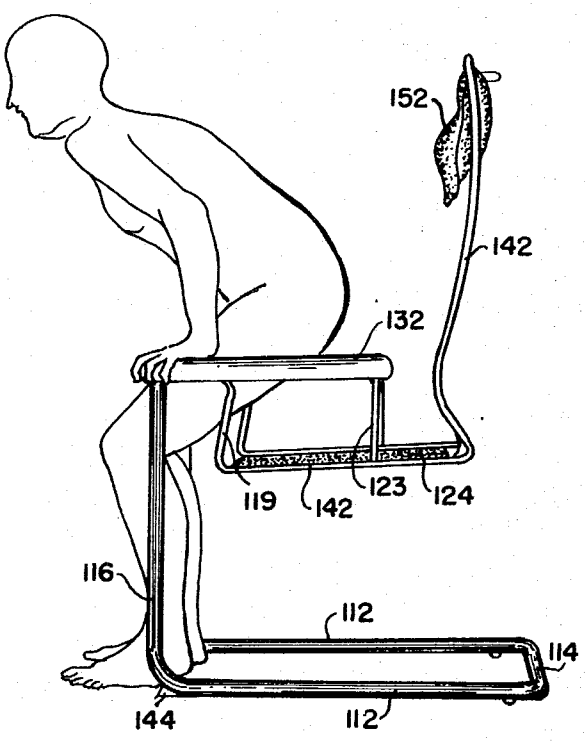
FIG. 12 is a side elevation showing how a user completes his exit from the chair.
Figure 11:
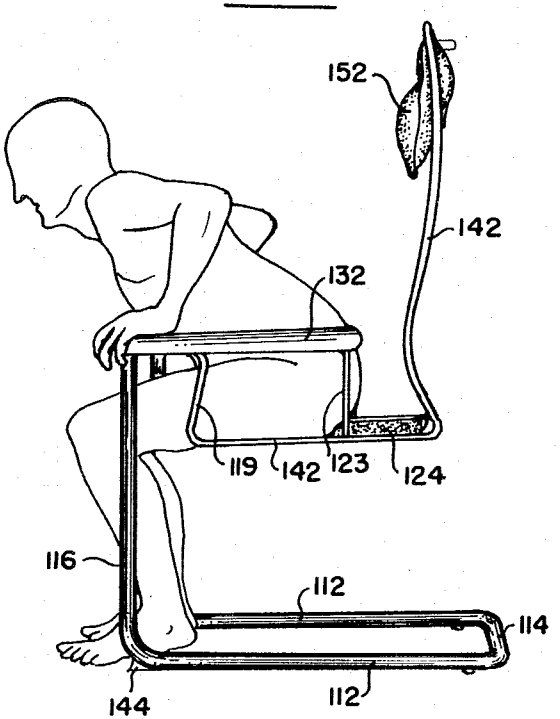
FIG. 10 is a side elevation of the chair of FIG. 7 under loading in normal use and FIG. 11 is a side elevation showing how a user, having first pulled himself forward, can push vertically down over the center of his feet thus calling his leg muscles into play in rising out of the chair into a standing position.
Figure 10:
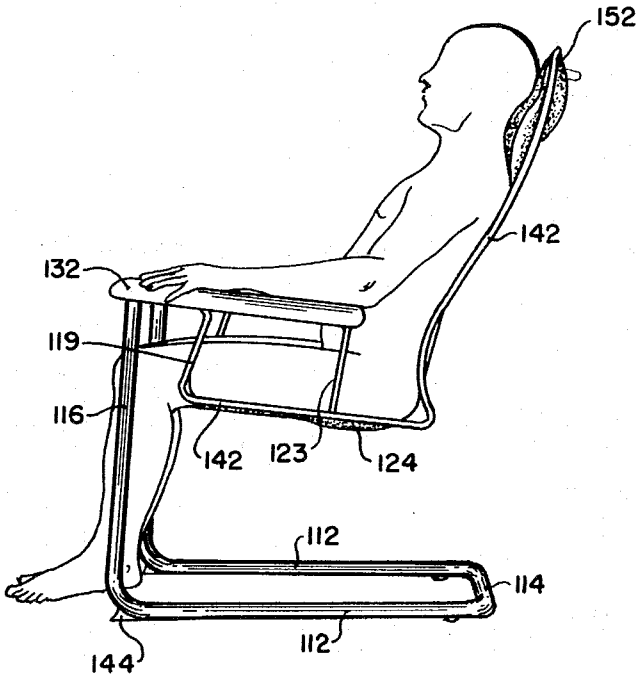

It should be noted that the forward edge of the seat is displaced rearwardly of the legs 116 by a substantial amount to assist the sitter in getting out of the chair because by pressing down on the forward ends of the arm rests 132 against the top of the rigid legs 116 he is pushing axially over the lower part of his legs and the center of gravity of his feet, bringing his leg muscles into play in rising out of the chair, as shown in FIGS. 10–12.

The invention provides, therefore, a relatively inexpensive patient's chair which is light and sturdy; which is eminently comfortable; which uses breathable and washable material; which provides a smooth, soothing rocking action; which minimizes skeletal shock to the patient upon impact when sitting down in the chair; which allows the sitter to rock backwards and forwards without his or her feet leaving the floor, and which above all is easy for the patient to get out of.

It will be appreciated that while particular embodiments of the invention have been shown and described, modifications may be made, including both a high-backed version and a low-backed version, either with or without arms, and it is intended in the following claims to cover all the embodiments which come within the true spirit and scope of the invention.

What is claimed is:

1. A chair capable of a rocking motion comprising:

(a) a substantially rigid base;

(b) a pair of substantially rigid supports attached to the base and extending upwardly from the base;

(c) a pair of side members supported by the base, each side member comprising a seat-supporting section substantially in parallel relationship with the base and a back-supporting section extending upwardly from the rear of the seat-supporting section, the side members supporting a seat and a back for the chair;

(d) a pair of arm-supporting members generally parallel to the plane of the seat and above the seat extending forwardly of the front of the seat, each arm-supporting member being fixedly supported in front of the seat by a respective one of the supports to resist forward, rearward, and vertical movement of the forward portion of the arm supporting members when sitting down into and standing up from the chair; and (e) means for permitting the side members and the arm-supporting members to rock with respect to the base.

2. The chair of claim 1 in which the side members are capable of flexing.

3. The chair of claim 1 in which the front portion of each side member is fixedly connected to a respective one of the arm-supporting members.

4. In a chair capable of a rocking motion comprising a base, a pair of side members having seat-supporting and back-supporting sections, the seat-supporting sections supporting a seat, and arm-supporting members above the seat, the improvement comprising substantially rigid supports extending upwardly from the base to a position above and forward of the seat, wherein the side members and the arm-supporting members are cantilevered from the supports above and forward of the seat for rocking without instability.

5. The chair of claim 2 in which the side members are structurally continuous and continuously flexible.

6. The chair of claim 4 in which the arm-supporting members extend forwardly of the seat.

7. The chair of claim 4 in which the side members are structurally continuous and continuously flexible.

8. The chair of claim 1 in which the means for permitting comprises means for cantilevering the side members and the arm-supporting members from the legs above and forward of the seat for rocking without instability.

9. The chair of claim 8 in which the side members and the arm-supporting members rock about a horizontal axis above the seat.

10. The chair of claim 9 in which the horizontal axis is forward of the seat.

11. The chair of claim 8 in which the side members and the arm-supporting members are cantilevered from the tops of the supports.

12. The chair of claim 4 in which the arm-supporting and side members pivot about a horizontal axis above the seat.

13. The chair of claim 12 in which the horizontal axis is forward of the seat.

14. The chair of claim 1 in which the supports alone support the side members and the arm-supporting members.

15. The chair of claim 3 in which the side members are capable of flexing, and including a substantially vertical tension member connecting each arm-supporting member to the corresponding side member at a point behind the front of the seat for maintaining the seat at a fixed distance below the arm-supporting members.

16. The chair of claim 5 in which the back-supporting members are curved for providing lumbar support corresponding to the flexing of the side members.

17. A chair capable of a rocking motion comprising:

(a) a substantially rigid base having a front pair of spaced upright legs;

(b) a pair of substantially horizontal arm rests extending rearwardly from the upper ends of the legs;

(c) mounting means at the upper end of each leg for cantilevered attachment of the respective arm rests;

(d) a body support having a substantially horizontal seat and a back extending upwardly from the rear of the seat; and (e) means for attaching the seat in a fixed relation below the arm rests;

wherein the mounting means are located higher than and farther forward than the seat so that the seat rocks together with the arm rests with respect to the legs about a front horizontal axis above the seat without instability.

18. The chair of claim 17 in which the legs alone are capable of supporting the arm rests and the body support.

19. The chair of claim 17 in which each mounting means comprises:

(a) a support welded to a respective one of the legs and extending rearwardly therefrom; and (b) clamp means for fastening a respective arm rest to the support, the clamp means supporting an upward cantilevered load component of the arm rest, a corresponding downward load component of the arm rest being supported by the support rearwardly of the clamp means.

20. The chair of claim 19 in which each flexible mount further comprises a resilient spacer between the support and the arm rest, the resilient spacer transmitting the downward load component for adding flexibility to the flexible mount; and wherein the clamp means includes an adjustment for inclining the seat for different seat back elevations and rocking characteristics.

21. The chair of claim 17 in which the body support further comprises a pair of oppositely disposed elongated flexible body-supporting members each having a seat-supporting section at the seat, a back-supporting section at the back, and an extension section forward of the seat, the extension section being cantilevered with a corresponding arm rest from the mounting means.

22. The chair of claim 21 in which the back-supporting sections are curved for providing lumbar support corresponding to the flexing of the body-supporting members.

23. The chair of claim 21 in which the means for attaching the seat in a fixed relation below the arm rests includes a pair of substantially vertical tension members each connecting a respective arm rest to a corresponding body-supporting member at a location behind the front of the seat, the tension members cooperating with the extension sections of the body-supporting members for maintaining the fixed relation.

24. A chair capable of a rocking motion comprising:

(a) a substantially rigid base having a front pair of spaced apart upright legs;

(b) a pair of substantially horizontal arm rests extending rearwardly from the upper ends of the legs;

(c) mounting means at the upper end of each leg for cantilevered attachment of the respective arm rests, each mounting means comprising:

(i) a support welded to a respective one of the legs and extending rearwardly therefrom;

(ii) clamp means for fastening a respective arm rest to the support, the clamp means supporting an upward load component of the arm rest;

(iii) a resilient spacer on the support rearward of the clamp means, the resilient spacer supporting a corresponding downward load component of the arm rest for adding flexibility to the flexible mount;

(d) a body support having a substantially horizontal seat and a back extending upwardly from the rear of the seat, the front of the seat being rearward of the legs, the body support comprising a pair of oppositely disposed, elongated flexible body-supporting members each comprising a seat-supporting section at the seat, a back-supporting section at the back, curved for providing lumbar support corresponding to the flexing of the body-supporting members, and an extension section forward of the seat, the extension section being attached to the mounting means of a corresponding arm rest; and (e) a pair of substantially vertical support members each connecting a corresponding body-supporting member to a corresponding arm rest at a location behind the front of the seat, wherein the tension members cooperate with the extension sections of the connectinhg a respective arm rest to a corresponding body-supporting member at a location behind the front of the seat, the tension members cooperating with the extension sections of the body-supporting members for maintaining the fixed relation.

25. The chair of claim 1 in which the substantially rigid supports are upright legs extending upwardly from the forward end of the base.

26. The chair of claim 4 in which the supports are a pair of upright legs extending upwardly from the forward end of the base.

* * * * *